United States Patent [19]

Malo

[11] 4,114,935

[45] Sep. 19, 1978

[54] BOX CAR ANTI-PILFERAGE DEVICE

[75] Inventor: Lowell L. Malo, St. Peters, MO

[73] Assignee: ACF Industries, Incorporated, New York, N.Y.

[21] Appl. No.: 745,038

[22] Filed: Nov. 26, 1976

Related U.S. Application Data

[62] Division of Ser. No. 636,350, Nov. 28, 1975, which is a division of Ser. No. 468,855, May 10, 1974, Pat. No. 3,978,618.

[51] Int. Cl.[2] ..... E05C 13/02

[52] U.S. Cl. ..... 292/104; 49/449

[58] Field of Search ..... 292/218, 104, 105, 133, 292/DIG. 4, 103, 107, 254; 49/449

[56] References Cited

U.S. PATENT DOCUMENTS

| | | | |
|---|---|---|---|
| 1,009,001 | 11/1911 | Weber | 292/104 X |
| 1,128,502 | 2/1915 | Pinnow | 292/104 X |
| 1,151,260 | 8/1915 | Flannery | 292/104 X |

*Primary Examiner*—Kenneth Downey
*Attorney, Agent, or Firm*—Henry W. Cummings

[57] ABSTRACT

A box car anti-pilferage device is adapted to be mounted on a railway box car having a sliding door a sufficient distance above the rail whereby the device is usually beyond the reach of thieves standing on the ground adjacent the rail. The device includes a door post having a transverse extension including a portion adapted to be engaged by a box car sliding door in closed position. A hasp locking member is pivotable about a generally horizontal axis upon either the box car sliding door or the door post extension. A tripped position plate is mounted upon the box car sliding door or the post extension, upon which the locking member is mounted. A locking plate is mounted on the other of the sliding door and the door post extension. The hasp locking member in locked position engages the locking plate. The hasp locking member is manually movable from the locked position to an open position out of engagement with the locking plate. A stop is provided for maintaining the hasp locking member in open position during initial movement of the sliding door from a door closed position toward a door open position. Gravity automatically moves the locking member from the open position to a tripped position engaging said tripping plate after the sliding door has moved a predetermined distance toward open position. The locking member includes a cam surface which causes the locking member to automatically assume a locked position engaging the locking plate when the box car sliding door has assumed the closed position.

5 Claims, 6 Drawing Figures

BOX CAR ANTI-PILFERAGE DEVICE

This is a division of application Ser. No. 636,350, filed Nov. 28, 1975 which in turn is a division of application Ser. No. 468,855 filed May 10, 1974 now U.S. Pat. No. 3,978,618.

BACKGROUND OF THE INVENTION

Anti-pilferage devices as proposed by AAR regulations must meet the following requirements.

The device is to be located considerably above the top of the rail so that it is difficult to reach in the yard except from a loading dock.

The device is to accept an additional locking device such as a car seal, a cable of at least ½ inch in diameter, or a lock, such as a padlock. In operation, the seal cable or lock must not be subjected to opening loads.

On a plug door, the device is to be located on the crank arm operating rod so that the crank arm cannot rotate and the door cannot be withdrawn from the closed and locked position.

In addition to the above requirements, some railroads have indicated that a self-latching feature is desirable wherein the device provides determent without a seal or lock inserted.

SUMMARY OF THE INVENTION

It therefore is an object of the present invention to provide an anti-pilferage device which substantially meets or exceeds the above requirements of the AAR regulations.

It is another object of the present invention to provide an anti-pilferage device which is self-latching.

A box car anti-pilferage device is adapted to be mounted on a railway box car having a sliding door a sufficient distance above the rail whereby the device is usually beyond the reach of thieves standing on the ground. The device includes a door post having a transverse extension including a portion adapted to be engaged by a box car sliding door in closed position. A hasp locking member is pivotably mounted about a generally horizontal axis upon one of the box car sliding door and the door post extension. A tripped position plate is mounted upon the box car sliding door, and the door post extension upon which the locking member is mounted. A locking plate is mounted on the other of the sliding door and the door post extension. The hasp locking member in locked position engages the locking plate. The locking member includes a cam surface, at least a portion of which is inclined with respect to the vertical. The hasp locking member is manually movable from said locked position to an open position out of engagement with the locking plate. Means are provided for maintaining the hasp locking member in open position during initial movement of the sliding door from a door closed position toward a door open position. Gravity automatically moves the locking member from the open position to a tripped position engaging the tripping plate after the sliding door has moved a predetermined distance toward open position. The locking member cam surface causes the locking member to automatically assume a locked position engaging the locking plate when said box car sliding door assumes the closed position.

THE DRAWINGS

Figure 1:
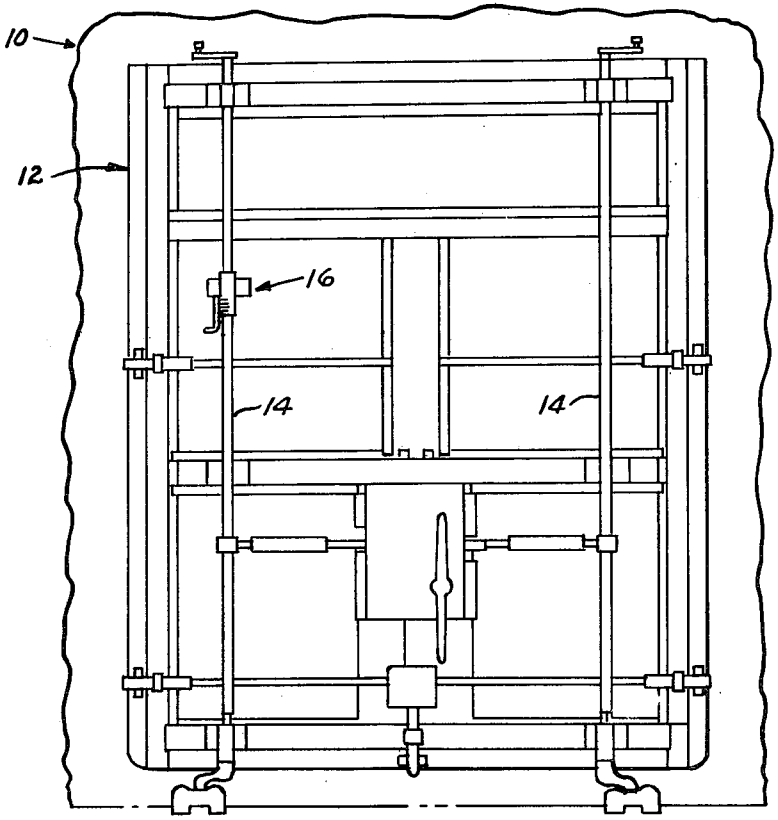
FIG. 1 is a side elevational view of a box car having a plug door and an anti-pilferage device according to the present invention.
Figure 2:
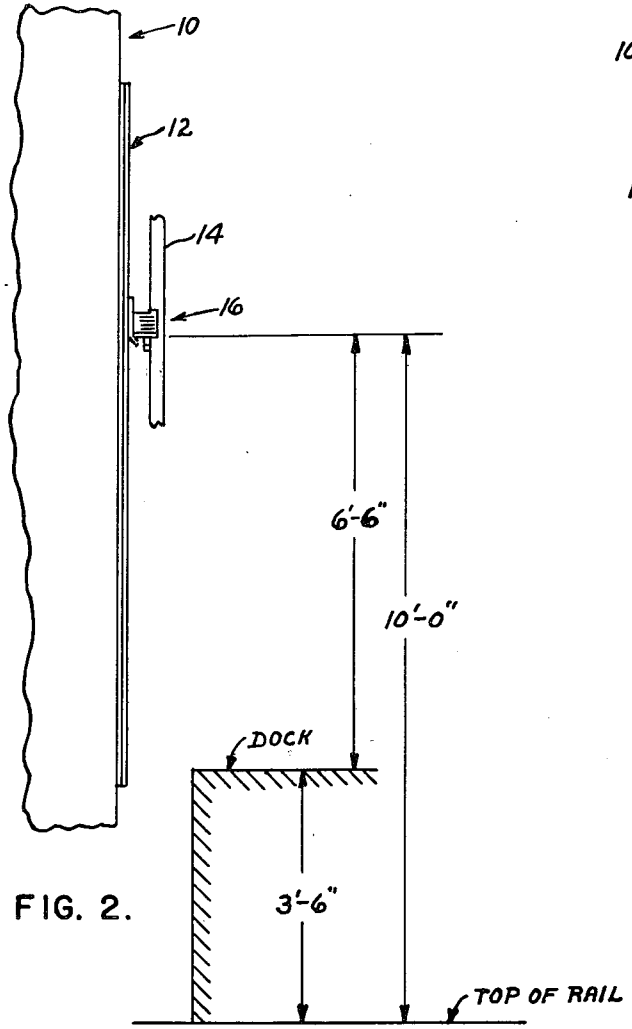
FIG. 2 is an end view of the box car and illustrating a loading and unloading dock.
Figure 3:
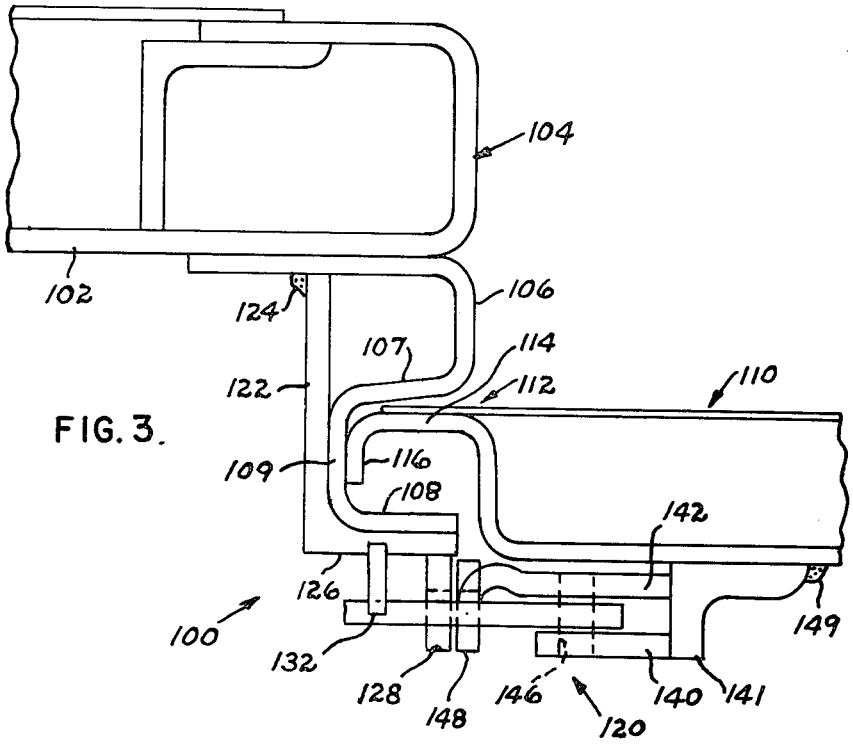
FIG. 3 is a plan view of an embodiment of the anti-pilferage device of the present invention applied to a sliding door box car.
Figure 4:
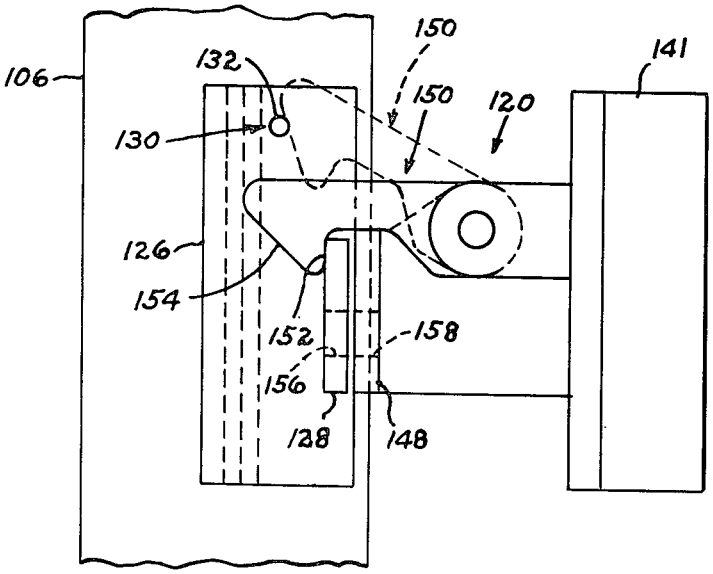
FIG. 4 is a side elevational view of the embodiment of the invention shown in FIG. 3.

One embodiment of the present invention is shown in FIGS. 3 and 4. In this embodiment an anti-pilferage device is applied to a sliding door box car indicated generally at 100. In this embodiment a box car side 102 comprises a fixed door post 104 of conventional construction. Door post 104 is provided with an extension 106 having longitudinal portions 107 and 108 and a transversely extending portion 109.

A conventional movable door indicated generally at 110 comprises a sealing extension 112 comprising longitudinally extending portion 114 and a transverse portion 116. A conventional door closure arrangement (not shown) is used to hold the door in the closed position.

The anti-pilferage device of the present invention indicated generally at 120 is placed above the rail a considerable distance, preferably at least 8 feet and most preferably approximately 10 feet, and comprises a transversely extending plate 122 integrally affixed to the fixed portion of the car door, for example, by welding indicated at 124. Plate 122 is provided with a longitudinally extending portion 126 which may be a part of plate 122 or integrally affixed to plate 122. Furthermore, a transverse or outwardly extending plate 128 is integrally affixed to plate 126, for example, by welding or plate 128 may be integrally formed with plate 122 and/or 126.

Preferably tripping means indicated generally at 130 are integrally affixed to plate 126. For example, the tripping means may comprise a pin 132 made of flexible material, for example, elastomeric or plastic material or metal having flexibility.

Mounted upon the movable portion of the door 110 are longitudinally extending plates 140 and 142 having a pin 146 extending therebetween. Mounted for pivotal movement about the pin 146 is a hasp member indicated generally at 150. Movable door portion 110 is also provided with a transversely extending member or plate 148 which, for example, may be integral with one of the plates 140 and 142. For example, plate 148 may be integrally formed with plate 142 or it may be mounted upon door portion 110 or to a bracket thereon. Preferably plate 140 and plate 142 are mounted upon a bracket or base 141 which is integrally affixed to the door, for example, by welding as indicated at 149.

Hasp locking member 150 comprises a locking portion 152 which in the locked position is adapted to engage outwardly extending plate 128. Hasp 150 is also provided with an inclined cam contour 154 adapted to ride up upon plate 128 and drop into the locked position shown in FIG. 10.

It therefore will be apparent that when the operator wishes to move the door from the locked position shown in FIG. 4 to an open position, a padlock, seal, chain or cable which may have been fastened through openings 156 and 158 respectively in member 128 and 148 is removed. He then moves hasp member 150 from the solid line position shown in FIG. 4 to the dotted position. In so doing, flexible member 132 will be deformed as it is canti-levered outwardly from plate 126. The door then can be moved to the right in FIGS. 3 and 4 to the open position. After the door has been moved a little way to the right the hasp member will drop down and ride upon outwardly extending plate 148 in a tripped position.

When the door is moved to the closed position from right to left the hasp member which is riding upon plate 148 will engage the plate 128 and the cam contour 154 will ride upwardly thereon and then drop into the locked position shown in FIG. 10. A padlock, seal, chain or cable can then be reapplied to openings 156 and 158.

Figure 5:
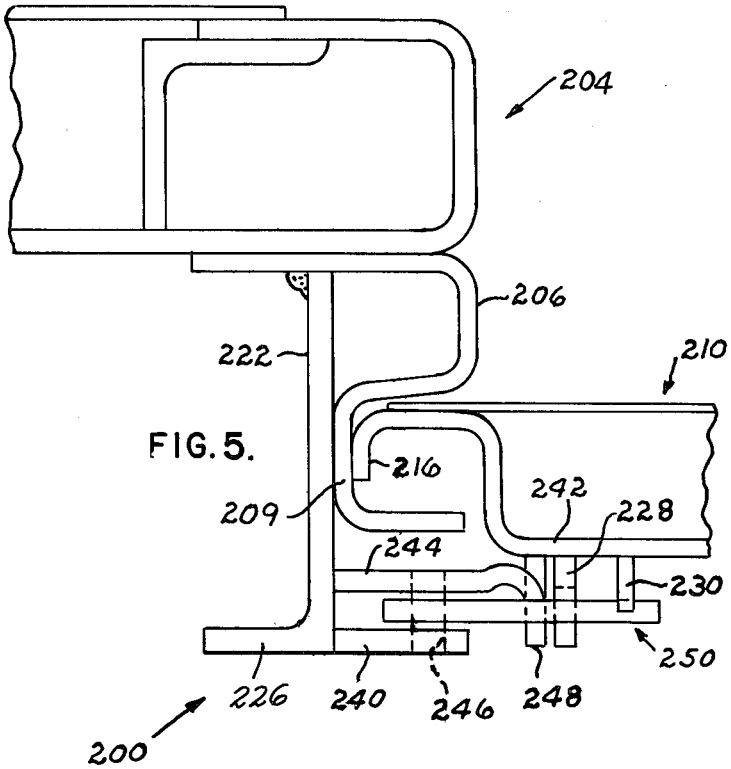
FIG. 5 is a plan view of an alternative embodiment of the anti-pilferage device shown in FIGS. 3 and 4 with the hasp mounted on a fixed portion of a sliding door.
Figure 6:
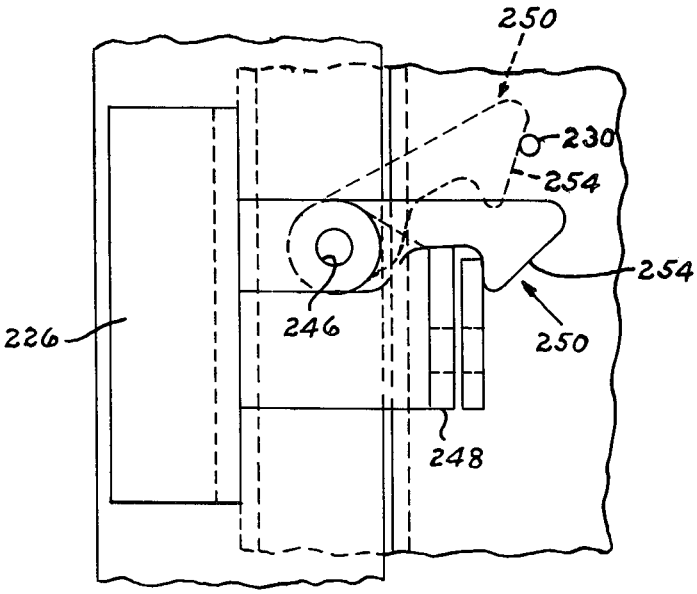
FIG. 6 is a side elevational of the embodiment of the invention shown in FIG. 5.

It will be apparent that the hasp member may be mounted upon the fixed portion of the car as shown in FIGS. 5 and 6. In this embodiment a sliding door indicated generally at 200 comprises a fixed door post 204 having a door post extension 206 including a sealing portion 209. A plate 222 is integrally affixed to post 204 having a longitudinal portion 226 extending in an opposite direction to portion 126 in FIGS. 3 and 4.

Thus in the embodiment shown in FIGS. 5 and 6 hasp 250 is mounted upon the fixed part of the door, for example, on plate 222 by means of plates 240 and 244, and pin 246. Preferably the latter has a horizontally extension 248. A transverse plate 228 is mounted on the movable portion of the door 242. In closed position, movable transverse seal portion 216 engages fixed transverse seal portion 209. In order to open the door, the operator moves hasp member 250 upwardly to the position shown dotted in FIG. 12 in engagement with tripping projection 230 mounted on the door. The movable portion of the door 210 is then moved outwardly. As the door moves outwardly, the hasp member drops to a generally horizontal position supported by plate 248. When the door is closed, the plate 228 engages nose cam contour 254 of the hasp and moves the same upwardly about pivot pin 246 until the hasp drops into the position shown in FIG. 6. A padlock, seal, chain or cable may then be placed in the openings in plates 228 and 248.

What is claimed is:

1. A box car anti-pilferage device adapted to be mounted on a railway box car having a sliding door a sufficient distance above the rail whereby the device is usually beyond the reach of thieves standing on the ground adjacent the rail comprising: a door post having a transverse extension including a portion adapted to be engaged by a box car sliding door in closed position; a hasp locking member pivotable mounted about a generally horizontal axis upon one of said box car sliding door and said door post extension; a tripped position plate mounted upon said one of said box car sliding door, and said door post extension; a locking plate mounted on the other of said sliding door and said door post extension; said hasp locking member in locked position engaging said locking plate; said hasp locking member including a cam surface, at least a portion of which is inclined with respect to the vertical; said hasp locking member being manually movable from said locked position to an open position out of engagement with said locking plate; stop means located above said locking plate comprising an outwardly extending stop member made of flexible material mounted upon the other of said sliding door and said door post extension; said member being displaced as said hasp locking member assumes said open position; said stop member maintaining said hasp locking member in said open position during initial movement of said sliding door from a door closed position toward a door open position; means for moving said locking member automatically from the open position to a tripped position engaging said tripped position plate after said sliding door has moved a predetermined distance toward open position; said locking member cam surface effective to cause said locking member to automatically assume a locked position from said tripped position engaging said locking plate without additional adjustment of the anti-pilferage device by the operator when said box car sliding door assumes the door closed position.

2. An anti-pilferage device according to claim 1 wherein said locking plate and said tripping plate each comprise openings which align when said box car sliding door assumes the closed position, which openings are adapted to receive an additional railway car locking device.

3. An anti-pilferage device according to claim 1 wherein said hasp locking member is mounted on said door post extension.

4. An anti-pilferage device according to claim 1 wherein said hasp locking member is mounted upon said box car sliding door.

5. A box car anti-pilferage device according to claim 1 wherein said stop member extends generally horizontally outwardly from said other of said sliding door and said door post extension.

* * * * *

UNITED STATES PATENT AND TRADEMARK OFFICE

CERTIFICATE OF CORRECTION

PATENT NO. : 4,114,935

DATED : September 19, 1978

INVENTOR(S) : Lowell L. Malo

It is certified that error appears in the above-identified patent and that said Letters Patent are hereby corrected as shown below:

Col. 2, between lines 17 and 18, insert --DESCRIPTION OF PREFERRED EMBODIMENTS--.

Col. 2, lines 45 and 47, delete "tripping" and insert therefor --stop--.

Col. 3, line 39, "FIG. 12" should read --FIG. 6--.

Col. 4, line 5, "pivotable" should read --pivotably--.

Signed and Sealed this

*Ninth* Day of *January 1979*

[SEAL]

*Attest:*

RUTH C. MASON
*Attesting Officer*

DONALD W. BANNER
*Commissioner of Patents and Trademarks*